US005789859A

United States Patent [19]

Watkins et al.

[11] Patent Number: 5,789,859

[45] Date of Patent: Aug. 4, 1998

[54] FIELD EMISSION DISPLAY WITH NON-EVAPORABLE GETTER MATERIAL

[75] Inventors: Charles M. Watkins; David A. Cathey, both of Boise, Id.

[73] Assignee: Micron Display Technology, Inc., Boise, Id.

[21] Appl. No.: 755,589

[22] Filed: Nov. 25, 1996

[51] Int. Cl.[6] ..... H01J 17/24

[52] U.S. Cl. ..... 313/495; 313/554; 313/559

[58] Field of Search ..... 313/495, 554, 313/559, 329, 336, 351; 445/55

[56] References Cited

U.S. PATENT DOCUMENTS

| | | | |
|---|---|---|---|
| 5,223,766 | 6/1993 | Nakayama et al. | 313/559 |
| 5,614,785 | 3/1997 | Wallace et al. | 313/559 |
| 5,656,889 | 8/1997 | Niiyama et al. | 313/559 |

*Primary Examiner*—Sandra L. O'Shea
*Assistant Examiner*—Vip Patel
*Attorney, Agent, or Firm*—Seed and Berry LLP

[57] ABSTRACT

The present invention provides an FED with a getter material deposited and activated on the substrates of the faceplate and the baseplate of the FED. In one embodiment of the invention, a large FED includes a faceplate, a baseplate, and an unactivated non-evaporable getter material. The faceplate has a transparent substrate with an inner surface, and a cathodoluminescent material disposed on a portion of the inner surface. The baseplate has a base substrate with a first surface and an emitter array formed on the first surface. The baseplate and the faceplate are coupled together to form a sealed vacuum space in which the inner surface and the first surface are juxtaposed to one another in a spaced-apart relationship across a vacuum gap. The unactivated non-evaporating getter material is deposited directly on the inner surface and/or the first surface. The unactivated non-evaporating getter material may alternatively be deposited on a thin film of bonding material that is disposed on the inner surface and/or the first surface.

10 Claims, 4 Drawing Sheets

FIELD EMISSION DISPLAY WITH NON-EVAPORABLE GETTER MATERIAL

This is invention was made with Government support under Contract No. DABT63-93-C-0025 awarded by Advanced Research Projects Agency (ARPA). The Government has certain rights in this invention.

TECHNICAL FIELD

The present invention relates to the use of getter materials in field emission displays, and, more particularly, to incorporating a non-evaporable getter material into an FED in a minimal amount of space.

BACKGROUND OF THE INVENTION

Field emission displays (FEDs) are packaged vacuum microelectronic devices that are used in connection with computers, television sets, camcorder viewfinders, and other electronic devices requiring flat panel displays. FEDs have a baseplate and a faceplate juxtaposed to one another across a narrow vacuum gap. In large FEDs, a number of spacers are positioned between the baseplate and the faceplate to prevent atmospheric pressure from collapsing the plates together. The baseplate typically has a base substrate upon which a number of sharp, cone-shaped emitters are formed, an insulator layer positioned on the substrate having apertures through which the emitters extend, and an extraction grid formed on the insulator layer around the apertures. Some FEDs, and especially smaller FEDs, also have a backplate coupled to the faceplate such that the backplate encloses the baseplate in a vacuum space. The faceplate has a substantially transparent substrate, a transparent conductive layer disposed on the transparent substrate, and a photoluminescent material deposited on the transparent conductive layer. In operation, a potential is established across the extraction grid and the emitter tips to extricate electrons from the emitter tips. The electrons pass through the holes in the insulator layer and the extraction grid, and impinge upon the photoluminescent material in a desired pattern.

One problem with FEDs is that the internal components continuously outgas, which causes the performance of FEDs to degrade over time. The effects of outgassing are minimized by placing a gas-absorbing material (commonly called getter material) within the sealed vacuum space. Accordingly, to absorb the gas in the vacuum chamber over an FED's lifetime, a sufficient amount of getter material must be incorporated into the FED before it is sealed. Also, a sufficient amount of space must be allowed between the getter material and the component parts of the FED to allow a passageway for the gas to travel to the surface area of the getter material.

In conventional FEDs, the getter material is deposited and activated on a metal plate separately from the other component parts of the FED. Getter material is activated by heating it to a temperature at which a passivation layer on its exposed surfaces is diffused. Non-evaporable getter materials used in FEDs activate at approximately 900° C. The base substrate, transparent substrate and backplate, however, are generally made from materials that begin to deform at approximately 450° C.–500° C., the temperature range at which many glass substrates and semiconductor substrates anneal. Accordingly, in order to avoid damaging the substrates, unactivated getter material is conventionally deposited and then activated on a metal plate apart from the substrates. The metal plate with activated getter material is then mounted on one of the substrates of an FED. The metal plate and getter material together are generally about 150 μm thick.

The metal plate and getter material are mounted on small FEDs differently than they are on large FEDs. In small FEDs, the metal plate is generally mounted on a support member between the backplate and the baseplate. In large FEDs, the metal plate is commonly mounted on either the faceplate, the baseplate, or in a pump out tube.

Conventional FEDs and manufacturing methods present unique problems for incorporating getter material into the display assemblies because the distance between the faceplate and baseplate should be minimized. One problem is that the thickness of the metal plate and getter material together is a limiting factor in reducing the distance between the faceplate and the baseplate. In large FEDs, the distance between the faceplate and the baseplate is desirably 25 μm–200 μm; the 150 μm thickness of the getter material and metal plate, therefore, often requires the faceplate and baseplate to be spaced apart by more than the desired distance. Another problem is that the metal plate increases the cost to manufacture an FED because it is a separate part and must be securely attached to another component part of the FED to prevent it from coming loose. Loose metal plates are a significant problem in FEDs because small particles of getter material may break away from a loose plate, causing shorting to occur across the emitter tips.

In light of the problems associated with incorporating getter material on a metal plate into conventional FEDs, it would be desirable to develop an FED and a method of manufacturing an FED in which non-evaporable getter materials are securely attached to the FED in a minimal amount of space and are activated after being incorporated in the FED.

SUMMARY OF THE INVENTION

The present invention is an inventive FED with a getter material that is deposited and activated on the substrates of the faceplate, baseplate and/or backplate. In one embodiment of the invention, a large FED includes a faceplate, a baseplate, and an unactivated non-evaporable getter material. The faceplate has a transparent substrate with an inner surface and a cathodoluminescent material disposed on a portion of the inner surface. The baseplate has a base substrate with a first surface and an emitter array formed on the first surface. The baseplate is coupled to the faceplate so that the inner surface and the first surface are juxtaposed to one another in a spaced-apart relationship across a vacuum gap. The unactivated non-evaporating getter material for absorbing gas within the space is deposited directly onto the inner surface and/or the first surface.

In another embodiment of the invention, a small FED includes a faceplate, a backplate, a baseplate, and an unactivated non-evaporable getter material. The faceplate has a transparent substrate with an inner surface and a cathodoluminescent material disposed on the inner surface. The backplate has an interior surface coupled to the faceplate so that the interior surface and the inner surface form a sealed chamber in which a vacuum is drawn. The baseplate has a base substrate with a first surface, a second surface, and an emitter array formed on the first surface. The baseplate is coupled to the faceplate such that the inner surface and the first surface are juxtaposed to one another in a spaced-apart relationship in the vacuum chamber. The unactivated non-evaporating getter material for absorbing outgassed matter within the vacuum gap is deposited directly onto the inner surface, the interior surface, the first surface, and/or the second surface.

In an embodiment of the method of the invention, an unactivated getter material is deposited on a surface of a substrate that is a component part of either the faceplate or the baseplate. The getter material is then selectively heated to its activation temperature by a focused energy source while it is on the substrate.

DETAILED DESCRIPTION OF THE INVENTION

Figure 1:
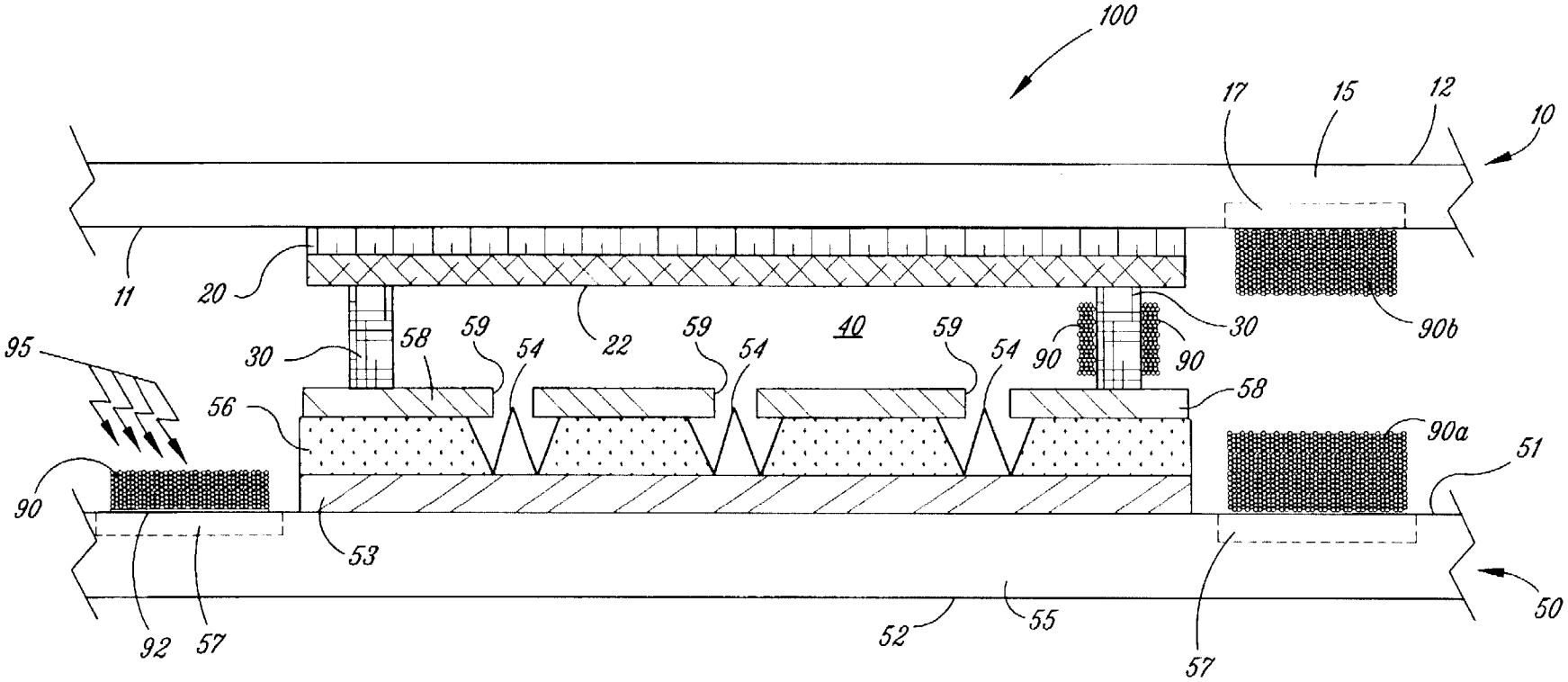
FIG. 1 is a cross-sectional view of a portion of a large field emission display with a getter material incorporated therein in accordance with the invention.
Figure 3:
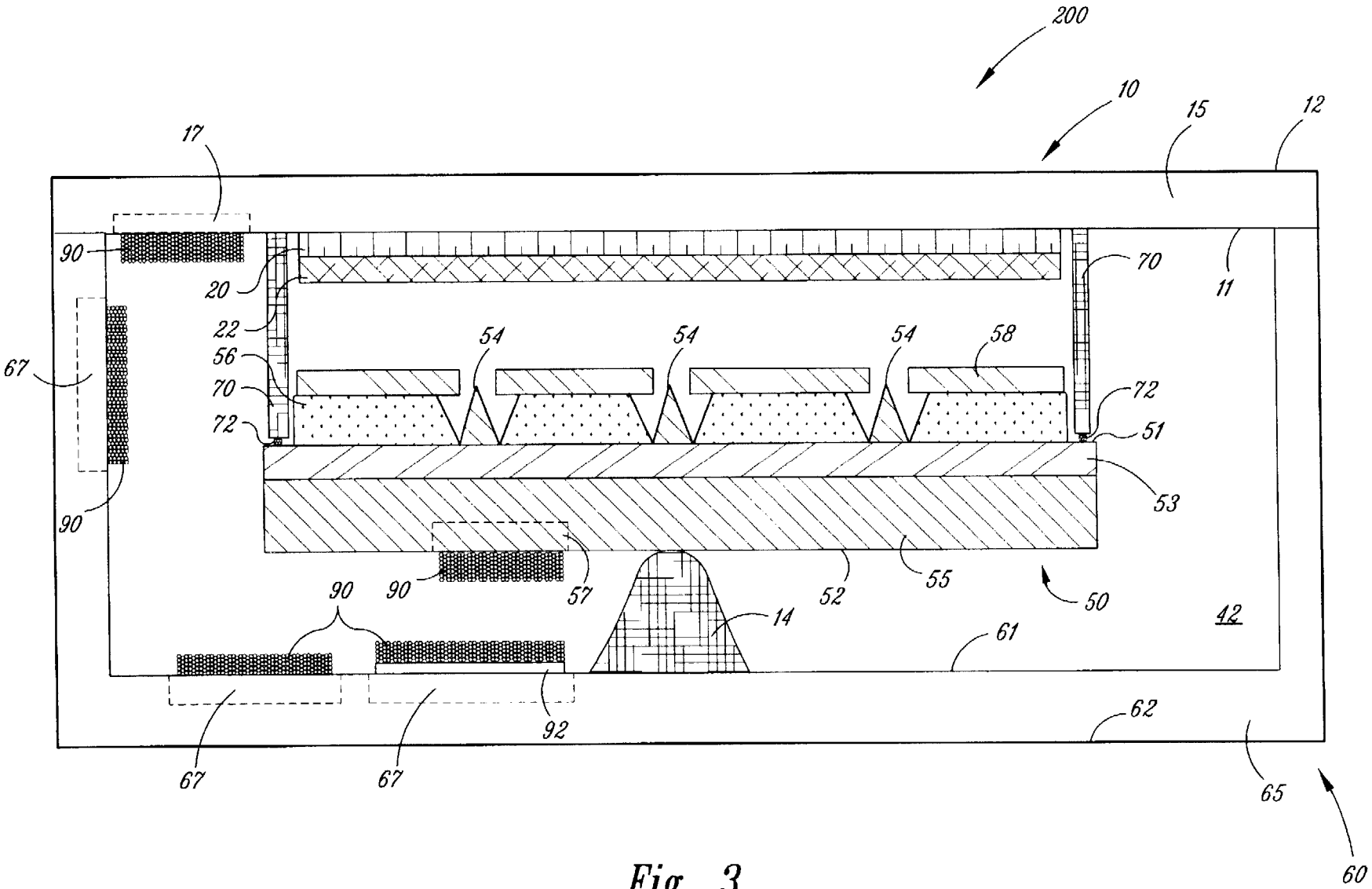
FIG. 3 is a cross-sectional view of a small field emission display with a getter material incorporated therein in accordance with the invention.

FIGS. 1 and 3 illustrate the inventive FEDs of the present invention in which an unactivated getter material is deposited and then subsequently activated on the substrates of the faceplate, baseplate and/or backplate. The present invention solves the problems associated with incorporating getter material into conventional FEDs by eliminating the metal substrate upon which getter material is conventionally deposited and activated; instead, the present invention deposits unactivated, non-evaporable getter material onto the substrates of the faceplate, baseplate, or backplate. An important aspect of the present invention is that the getter material is activated after it has been deposited on the substrates by selectively heating the getter material to its activation temperature of approximately 900° C. without heating the substrates above their annealing temperatures of approximately 450°–500° C. for any significant period of time. Specific features of the invention and its advantages are described in detail herein.

FIG. 1 illustrates a portion of a large FED with a faceplate 10, a baseplate 50, and a vacuum gap 40 therebetween in which a vacuum is drawn. The faceplate 10 has a transparent substrate 15 with an inner surface 11 facing the vacuum gap 40 and an outer surface 12 exposed to the atmosphere. The transparent substrate 15 is generally made from glass that begins to deform at approximately 450°–500° C. An electrically conductive layer of material 20 and a cathodoluminescent layer of material 22 are disposed on the inner surface 11 across a portion of the transparent substrate 15. The baseplate 50 has a base substrate 55 with a first surface 51 that faces the inner surface 11 of the faceplate 10 and a second surface 52 that defines the backside of the baseplate 50. The base substrate 55 is preferably made from a type of glass that also anneals at approximately 450°–500° C. A second layer of conductive material 53 is disposed on the first surface 51 of the base substrate 55, and a large number of emitters 54 are formed on the conductive material 53. A dielectric material 56 is positioned on the conductive material 53 and the base substrate 50, and a number of holes are etched in the dielectric material 56 around and above the emitter tips 54. An extractor grid 58 is positioned on top of the dielectric material 56. The extractor grid 58 has a number of openings 59 positioned over the tips of the emitters 54 to allow electrons to pass through the grid 58 to the cathodoluminescent material 22. The faceplate 10 and baseplate 50 are maintained in a spaced-apart relationship under the influence of the vacuum by a number of spacers 30 positioned at various locations throughout the FED.

A getter material 90 is deposited in its unactivated state on the inner surface 11 of the faceplate 10 and/or the first surface 51 of the baseplate 50. The getter material 90 is a non-evaporable getter material that is preferably made from a titanium and zirconium alloy. Two suitable non-evaporable getter materials are a titanium and Zr84-A116 alloy, and a titanium and Zr70-V24.6-Fe5.4 alloy manufactured by SAES Getters, SpA. Other suitable non-evaporable getter materials include molybdenum and thorium. The getter material 90 may be deposited directly on the substrates by electroplating, screen printing, settling out of solution, electrophoresis processing, or other suitable deposition processes. In another embodiment, the getter material 90 may be deposited on the sides of the spacers 30 to increase the amount of getter material in the large FED 100. The thickness of the getter material 90 depends upon the amount of getter material that is required for a specific design and the total surface area within the FED 100 upon which the getter material 90 may be deposited. The getter material 90 is generally between 10 μm and 100 μm thick.

In a preferred embodiment, a thin film of bonding material 92 is disposed onto the surface of the substrate 55 of the baseplate 50 before the getter material 90 is deposited onto the substrate 55. The bonding material 92 may also be disposed onto the faceplate substrate 15. The bonding material 92 is preferably a very thin layer of nickel that is approximately 1–20 μm thick. Other suitable bonding materials include nickel-chrome, stainless steel, molybdenum, titanium and zirconium. The bonding material 92 provides a stronger bond between the getter material 90 and the substrates 15 and 55. Accordingly, the bonding material 92 reduces the risk that a particle of getter material 90 will break away from the substrates 15 or 55.

After the getter material 90 has been deposited onto the faceplate 10, baseplate 50, and/or spacers 30, it must be activated in a vacuum without deforming or otherwise ruining the substrates 15 and 55. As discussed above, a non-evaporable getter material is activated by heating it to approximately 900° C. to cause a passivation layer on its exposed surfaces to diffuse. Because the annealing temperature of the substrates 15 and 55 is only about 450°–500° C., one important aspect of the invention is the process by which the getter material 90 is activated at 900° C. after it has been deposited on the substrates 15 or 55 without deforming or otherwise damaging the substrates.

The getter material 90 is activated while on the substrates 15 and 55 by selectively heating the getter material 90 with a focused, high-intensity energy source 95 such as a microwave emitter, a radio frequency transmitter, a laser, or an RTP process. Other energy systems that quickly heat the getter material 90 to its activation temperature without adversely affecting the substrates may also be used. By focusing the high-intensity energy 95 only onto the getter material 90, the temperature of the getter material 90 rises much faster than that of the substrates 15 and 55. Moreover, since the materials from which the substrates 15 and 55 are made are reasonably resistant to heat transfer, only the small interior regions 17 and 57 of the substrates adjacent to the getter material 90 generally reach the annealing temperatures of the substrates.

Figure 2:
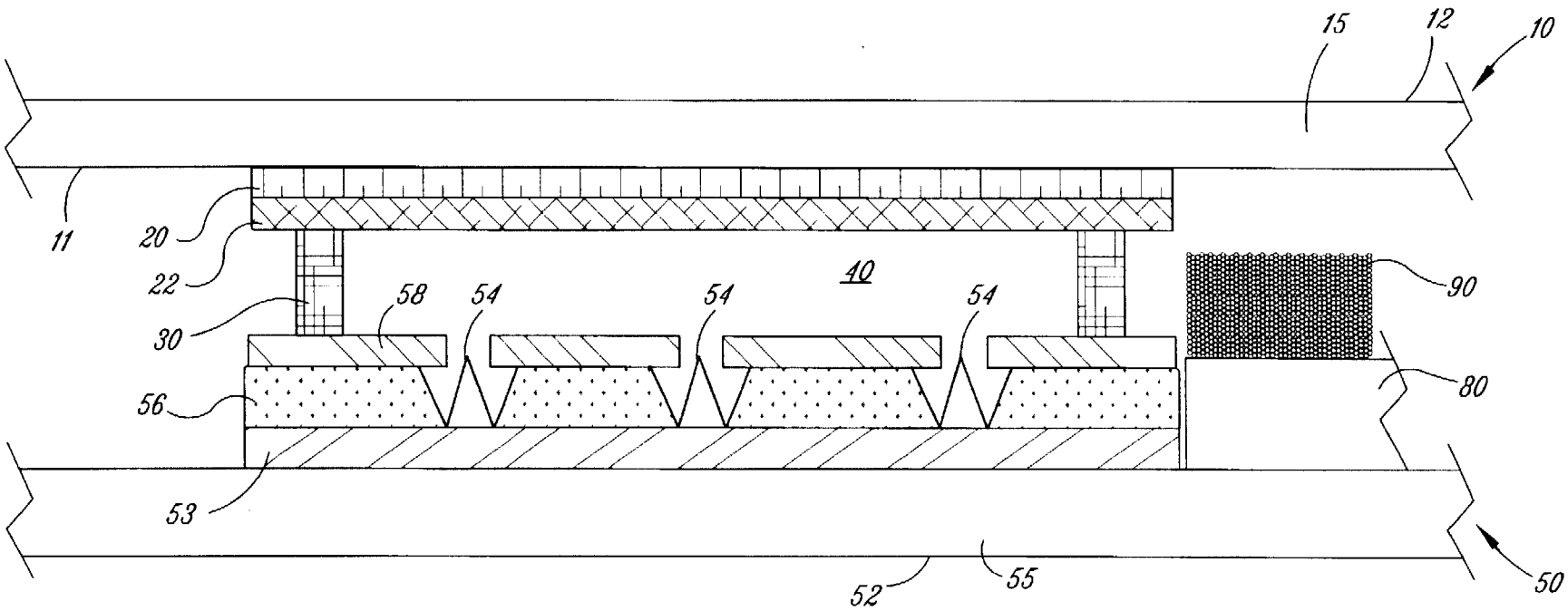
Fig. 2 (Prior Art)
FIG. 2 is a cross-sectional view of a portion of a conventional large field emission display with a getter material.

The large FED 100 has several advantages over conventional FEDs. One advantage is that the present invention allows more getter material 90 to be incorporated into the FED 100 in thinner layers. Referring to FIG. 2, in which like reference numbers refer to like parts in FIG. 1, a conventional FED is shown in which the getter material 90 is deposited onto a metal plate 80. The metal plate 80 is attached to either the faceplate 10 or the baseplate 50, and it is approximately 75 μm thick. The getter material 90 in conventional FEDs is also approximately 75 μm thick.

The present invention, however, eliminates the metal plate 80 which reduces the space required to incorporate the getter material into the FED. Moreover, by eliminating the metal plate 80, more getter material may be incorporated into an FED of the invention in less space compared to conventional FEDs. Referring again to FIG. 1, a 60 μm layer of getter material 90*a* may be juxtaposed to a 50 μm layer of getter material 90*b*; thus, for example, 110 μm of getter material may be incorporated in an FED of the present invention in 40 μm less space than 75 μm of getter material in a conventional FED with a 75 μm thick metal plate.

FIG. 3, which also uses like reference numbers to indicate like parts in FIG. 1, illustrates another embodiment of the invention in which the getter material 90 is deposited on various surfaces in a small FED 200. The small FED 200 has a faceplate 10, a baseplate 50, and a backplate 60. The backplate 60 is attached to the faceplate 10 such that it encloses the baseplate 50 in a vacuum space 42. A number of connectors 70 extend between the inner surface 11 of the faceplate 10 and the second electrically conductive layer 53 of the baseplate 50. The connectors 70 are bonded to the leads of the electrical conductive layer 53 in the baseplate 50 by a conductive bonding compound 72. The baseplate 50 is further supported by a support 14 positioned between the backplate 60 and the second surface 52 of the baseplate 50.

In the small display 200, a layer of getter material 90 may be deposited in its unactivated state on an interior surface 61 of the backplate 60, the inner surface 11 of the faceplate 10, or the second surface 52 of the baseplate 50. The getter material 90 in the small FED 200 is deposited and activated in the same manner as described above with respect to the large FED 100 in FIG. 1. Accordingly, only the small interior regions 17, 57 and 67 adjacent to the getter material 90 generally reach their respective annealing temperatures.

Figure 4:
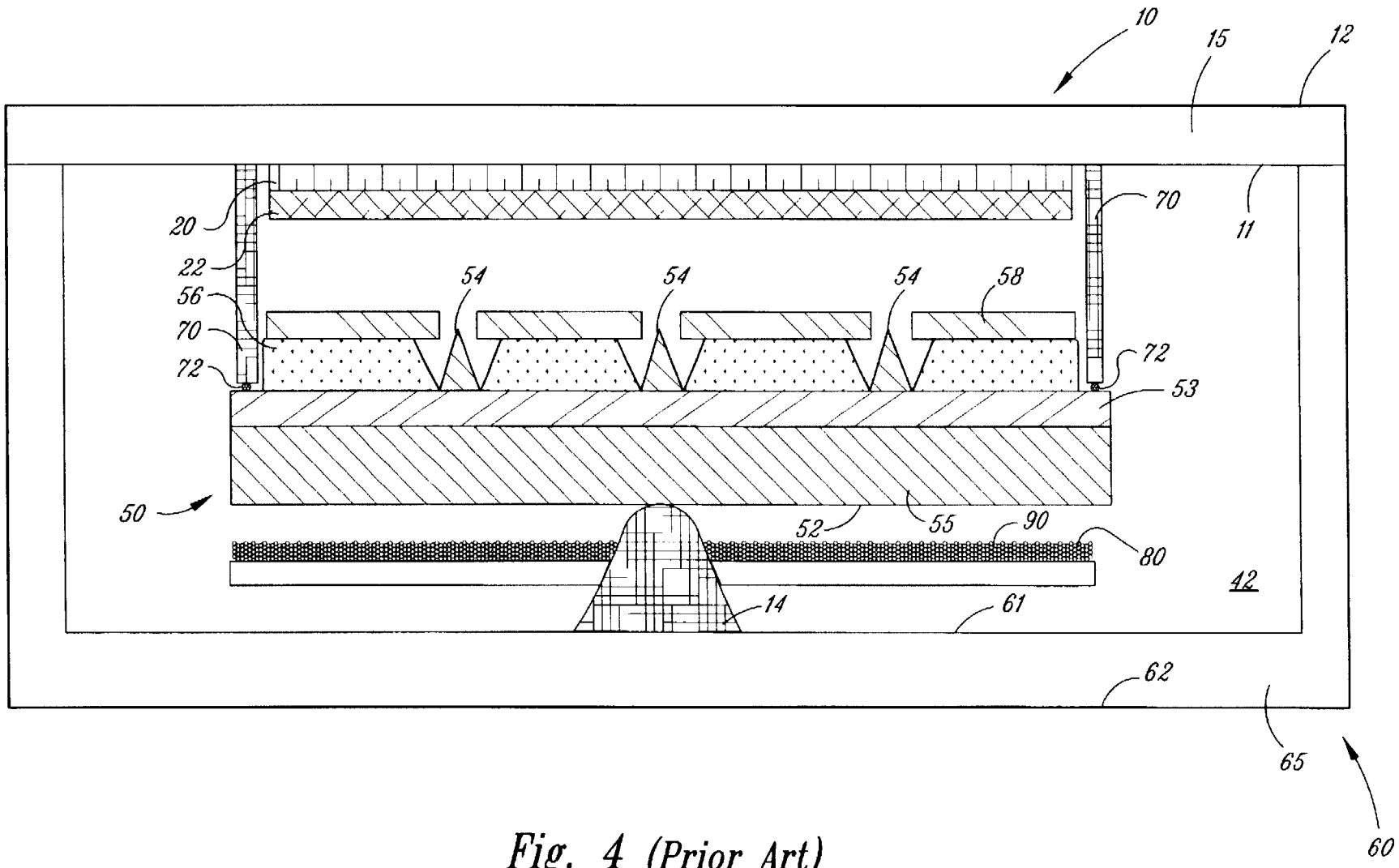
Fig. 4 (Prior Art)
FIG.4 is a cross-sectional view of a conventional small field emission display having a getter material.

The small FED 200 also has several advantages over conventional FEDs. Referring to FIG. 4, in which like reference numbers indicate like parts in FIG. 3, a conventional small FED is depicted with a getter material 90 deposited on a metal plate 80. Typically, the metal plate 80 has a hole in the middle through which the conical support 14 is positioned. The metal plate 80, therefore, not only requires additional space to incorporate the getter material into the FED, but it is also subject to being dislodged from the support 14 and jostled within the vacuum space 42. As discussed above, the getter material may break away from the metal plate 80 and move throughout the vacuum space 42 until it causes shorting to occur between the emitters 54 and the conductive material 20. The FED 200 of the present invention substantially reduces the risk of particles coming loose and floating in the vacuum space 42 by securely attaching the getter material to the faceplate 10, baseplate 50, or backplate 60. The small FED 200 also allows more getter material 90 to be incorporated into the display for the reasons discussed above with respect to the large FED 100 in FIG. 1.

It will be appreciated that, although specific embodiments of the invention have been described herein for purposes of illustration, various modifications may be made without departing from the spirit and scope of the invention. Accordingly, the invention is not limited except as by the appended claims.

What is claimed is:

1. A field emission display assembly, comprising:

a faceplate having a transparent substrate with an inner surface, a conductive film disposed on the inner surface and a cathodoluminescent material disposed on the conductive film;

a baseplate having base substrate with a first surface and an emitter array on at least a portion of the first surface, the faceplate and the baseplate being coupled to one another to form a sealed vacuum space in which the inner surface and the first surface are juxtaposed to one another in a spaced apart relationship; and an unactivated non-evaporating metallic getter material for absorbing gas within the vacuum space, the getter material being deposited directly on at least one of the inner surface and the first surface.

2. The field emission display of claim 1, further comprising a spacer positioned between the face plate and the base plate, the getter material being deposited and activated on at least one of the inner surface, the first surface and the spacer.

3. The field emission display of claim 2 wherein the getter material is deposited and activated on the inner surface, the first surface and the spacer.

4. The field emission display of claim 1 wherein the getter material is deposited and activated on the inner surface and the first surface.

5. The field emission display of claim 1 wherein the getter material comprises at least one from the group consisting of titanium, thorium, molybdenum and zirconium.

6. A field emission display assembly, comprising:

a faceplate having a transparent substrate with an inner surface, a conductive film disposed on the inner surface and a cathodoluminescent material disposed on the conductive film;

a baseplate having base substrate with a first surface and an emitter array on at least a portion of the first surface, the faceplate and the baseplate being coupled to one another to form a sealed vacuum space in which the inner surface and the first surface are juxtaposed to one another in a spaced apart relationship;

a thin film of bonding material disposed directly on at least one of the inner surface and the first surface; and an unactivated non-evaporating getter material for absorbing gas within the vacuum space, the getter material being deposited on the film of bonding material.

7. The field emission display of claim 6 wherein the bonding material comprises a 1 μm–20 μm thick layer of one from the group consisting of nickel, nickel-chrome, stainless steel, molybdenum, zirconium and titanium.

8. A field emission display assembly, comprising:

a faceplate having a transparent substrate with an inner surface, a conductive film on the inner surface and a cathodoluminescent material disposed on the conductive film;

a backplate having an interior surface, the backplate being coupled to the faceplate so that the interior surface and inner surface form a sealed chamber in which a vacuum is drawn;

a baseplate having a base substrate with a first surface, a second surface, and an emitter array on at least a portion of the first surface, the baseplate being positioned in the chamber and coupled to the faceplate such that the inner surface and the first surface are juxtaposed to one another in a spaced apart relationship; and an unactivated non-evaporating metallic getter material for absorbing gas within the chamber, the getter material being directly deposited on at least one of the inner surface, the interior surface, the first surface and the second surface.

9. The field emission display of claim 8 wherein the getter material comprises at least one from the group consisting of titanium, thorium, molybdenum and zirconium.

10. A field emission display assembly, comprising:

a faceplate having a transparent substrate with an inner surface, a conductive film on the inner surface and a cathodoluminescent material disposed on the conductive film;

a backplate having an interior surface, the backplate being coupled to the faceplate so that the interior surface and inner surface form a sealed chamber in which a vacuum is drawn;

a baseplate having a base substrate with a first surface, a second surface, and an emitter array on at least a portion of the first surface, the baseplate being positioned in the chamber and coupled to the faceplate such that the inner surface and the first surface are juxtaposed to one another in a spaced apart relationship;

a thin film of bonding material disposed directly on at least one of the inner surface, the interior surface, the first surface and the second surface; and an unactivated non-evaporating getter material for absorbing gas within the chamber, the getter material being deposited directly on the film of bonding material.

* * * * *